US012000682B2

(12) United States Patent
Blecher et al.

(10) Patent No.: US 12,000,682 B2
(45) Date of Patent: Jun. 4, 2024

(54) EXPANDING BULLET

(71) Applicants: SHU Schuermann Hilleke Umformtechnik GmbH & Co. KG, Neuenrade (DE); RUAG Ammotec GmbH, Fuerth (DE)

(72) Inventors: Joerg Peter Blecher, Hagen (DE); Manfred Geier, Puchheim (DE); Florian Spanner, Nuremberg (DE)

(73) Assignees: SHU Schuermann Hilleke Umformtechnik GmbH & Co. KG, Neuenrade (DE); RUAG Ammotec GmbH, Fuerth (DE)

( * ) Notice: Subject to any disclaimer, the term of this patent is extended or adjusted under 35 U.S.C. 154(b) by 0 days.

(21) Appl. No.: 18/084,043

(22) Filed: Dec. 19, 2022

(65) Prior Publication Data

US 2023/0117939 A1 Apr. 20, 2023

Related U.S. Application Data

(60) Division of application No. 17/864,626, filed on Jul. 14, 2022, now abandoned, which is a continuation of application No. 17/193,147, filed on Mar. 5, 2021, now Pat. No. 11,402,186.

(30) Foreign Application Priority Data

Mar. 6, 2020 (DE) ..... 20 2020 101 249.5
May 26, 2020 (DE) ..... 20 2020 102 983.5

(51) Int. Cl.
*F42B 12/34* (2006.01)

(52) U.S. Cl.
CPC ..... *F42B 12/34* (2013.01)

(58) Field of Classification Search
CPC ..... F42B 12/34
USPC ..... 102/506–510
See application file for complete search history.

(56) References Cited

U.S. PATENT DOCUMENTS

| | | | | |
|---|---|---|---|---|
| 914,992 | A | 3/1909 | Taylor | |
| 1,101,743 | A | 6/1914 | Hoagland | |
| 4,882,822 | A | 11/1989 | Burczynski | |
| 5,811,723 | A | 9/1998 | Stone | |
| 11,079,207 | B1 * | 8/2021 | Burczynski | F42B 12/34 |
| 2014/0026779 | A1 | 1/2014 | Mekus | |
| 2017/0336186 | A1 | 11/2017 | Smith | |
| 2019/0186881 | A1 | 6/2019 | Spanner et al. | |

FOREIGN PATENT DOCUMENTS

DE 20 2020 100 174 U1 2/2020

* cited by examiner

*Primary Examiner* — Reginald S Tillman, Jr.
(74) *Attorney, Agent, or Firm* — Collard & Roe, P.C.

(57) ABSTRACT

An expanding bullet having a one-piece structure has a cylindrical section and a section that is essentially shaped as a truncated cone, with the bullet tip being situated at the end of the latter section, which end faces away from the cylindrical section, and at least one planned breaking point being formed in this section, wherein the section shaped as a truncated cone is divided into segments and has a channel that has a mouth in the region of the bullet tip, wherein the channel has a bell-shaped widened region, which has its greatest diameter in the region of the transition from the cylindrical section to the section shaped as a truncated cone.

11 Claims, 1 Drawing Sheet

EXPANDING BULLET

CROSS REFERENCE TO RELATED APPLICATIONS

This application is a divisional application of and Applicants claim priority under 35 U.S.C. § 120 and § 121 of U.S. patent application Ser. No. 17/864,626 filed on Jul. 14, 2022, which is a continuation of and claims priority under 35 U.S.C. § 120 on U.S. patent application Ser. No. 17/193,147 filed on Mar. 5, 2021, which claims priority under 35 U.S.C. § 119 of German Application No. 20 2020 101 249.5 filed on Mar. 6, 2020 and German Application No. 20 2020 102 983.5 filed on May 26, 2020, the disclosures of which are incorporated by reference. Certified copies of priority German Applications No. 20 2020 101 249.5 and No. 20 2020 102 983.5 are contained in grandparent U.S. patent application Ser. No. 17/193,147.

BACKGROUND OF THE INVENTION

1. Field of the Invention

The invention relates to an expanding bullet having a one-piece structure, which bullet has a cylindrical section and a section that is essentially shaped as a truncated cone, with the bullet tip being situated at the end of the latter section, which end faces away from the cylindrical section, and at least one planned breaking point being formed in this section, wherein the section shaped as a truncated cone is divided into segments and has a channel that has a mouth in the region of the bullet tip.

2. Description of the Related Art

An expanding bullet of the type stated initially is known, for example, from DE 20 2020 100 174 U1. Such bullets are characterized in that they are strongly braked after penetrating into the target, and thereby the bullet is prevented from passing through the target. The low penetration depth is achieved in that the bullet is bent open after penetrating into the target, in the region of the section shaped as a truncated cone, and thereby braking of the bullet is brought about. The planned breaking points provided in the section shaped as a truncated cone furthermore lead to tearing off of the segments, and thereby the effect of the bullet is increased.

SUMMARY OF THE INVENTION

The expanding bullets known from the state of the art meet the demands made on them. It is the task of the present invention to create an expanding bullet of the type stated initially, which has bullet properties that are just as good but at the same time can be produced more easily. This task is accomplished by means of the characteristics according to the invention.

With the invention, an expanding bullet is created, which is comparable, in terms of its effect, with known expanding bullets. However, on the basis of the design according to the invention, simpler and therefore more low-priced production is possible.

In a further development of the invention, at least one flaw is situated on the mantle surface of the section shaped as a truncated cone. The flaws lead to material weakening in the section of the bullet shaped as a truncated cone. They thereby increase the reliability with regard to unfolding and tearing off of the segments.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings.

DETAILED DESCRIPTION OF PREFERRED EMBODIMENTS

Figure 1:
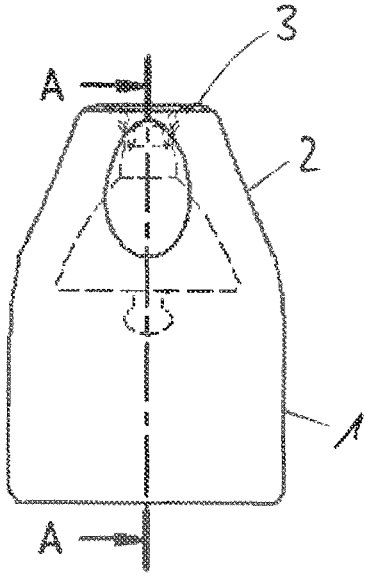
FIG. 1 shows a front view of an expanding bullet.

The expanding bullet selected as an exemplary embodiment has a single-piece structure. It has a cylindrical section 1 and a section 2 essentially shaped as a truncated cone. The bullet tip 3 is situated at the end of the section 2 shaped as a truncated cone that faces away from the cylindrical section 1. The section 2 shaped as a truncated cone is divided, in the exemplary embodiment, into four segments 4.1 to 4.4, which are brought about by means of incisions 5.1 to 5.4. In the region of the bullet tip 3, the expanding bullet has a mouth 6, which has a star-shaped shape.

Figure 2:
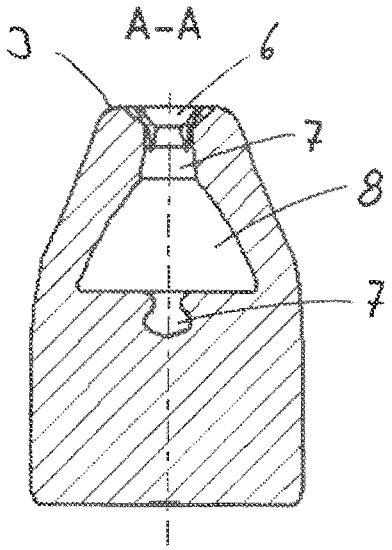
FIG. 2 shows the section through the expanding bullet along the line A-A in FIG. 1.
Figure 3:
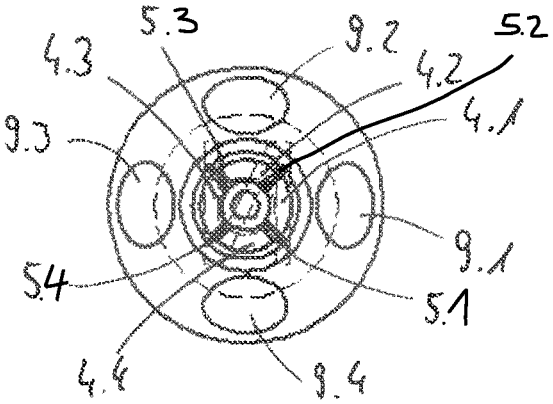
FIG. 3 shows the top view of the expanding bullet shown in FIG. 1.

The section 2 shaped as a truncated cone has a channel 7, which extends along the longitudinal axis of the expanding bullet. The channel 7 is configured in the manner of a dead-end bore. The channel 7 has a bell-shaped widened region 8, which has its greatest diameter in the region of the transition from the cylindrical section 1 to the section 2 shaped as a truncated cone (see FIG. 2).

In the exemplary embodiment, four flaws 9.1 to 9.4 are situated on the mantle surface of the section 2 shaped as a truncated cone 1. The flaws 9 are the result of the production process. This process can take place in a single massive-forming machine, and thereby transport of the semi-finished products is avoided. The production process is structured as follows:

The expanding bullet is produced from solid material, in the exemplary embodiment from copper wire. Other wire materials are also possible, depending on the application case. In the production of the expanding bullet according to the invention, the wire is first positioned in a forming machine. This can take place from a rolled-up wire coil, in cycled manner. The wire is then cut to length in the forming machine.

After the wire has been cut to length, in the next work step a radius is pressed onto the two end faces of the cut wire. Then one of the two end faces is center-punched. For this purpose, a tool that has a small hard tip is pressed into the end face, whereby a small circular depression is formed. This center-punched end face will later be the centering for the splitting tool. Subsequently, the end face provided with the center punch is split. This results in a crown-like or tulip-like shape, in the case of which four segments that are bent outward are brought about in the exemplary embodiment.

In the next processing step, using a cylindrical pin, material is pressed in the direction of the cylindrical section 1 that will form later. For this purpose, the cylindrical pin penetrates into the wire up to a specific depth from the split side, and pushes the material in front of it, whereby a planned breaking point occurs. After the pin is pulled out of the wire, the bullet shape is closed, whereby the bullet is finished. It then has the form that consists of the cylindrical section 1 and the section 2 essentially shaped as a truncated cone.

As the result of the displacement of the material using the pin, in the split state, a material-free region is formed, which region leads to the bell-shaped widened region 8 after the shape is closed. At the same time, the flaws 9 form on the mantle surface of the section 2 shaped as a truncated cone, when the shape is closed. These flaws lead to a further reduction of the wall thickness of the section 2 shaped as a truncated cone.

The expanding bullet according to the invention is very reliable and, at the same time, can be produced in simple and low-cost manner. High production speeds can be achieved, in particular, in the case of production on a single massive forming machine. As a result, the production costs are further reduced.

Although only a few embodiments of the present invention have been shown and described, it is to be understood that many changes and modifications may be made thereunto without departing from the spirit and scope of the invention.

What is claimed is:

1. A method for producing an expanding bullet, comprising:

providing a solid material; and processing, using massive forming, the solid material to produce the expanding bullet, wherein:

the expanding bullet has a cylindrical section and a truncated-cone-shaped section divided into segments, a bullet tip being situated at an end of the truncated-cone-shaped section that faces away from the cylindrical section;

the truncated-cone-shaped section includes at least one planned breaking point formed therein, and a channel having a mouth in a region of the bullet tip;

the processing of the solid material comprises splitting the end of the truncated-cone-shaped section into a plurality of segments and forming a central recess in the split end of the end of the truncated-cone-shaped section; and forming the central recess comprises penetrating, starting from the split end into the truncated-cone-shaped section to a depth and pressing portions of the solid material towards the cylindrical section.

2. The method according to claim 1, wherein the channel has a bell-shaped widened region, a greatest diameter of the bell-shaped widened region being in a region of transition from the cylindrical section to the truncated-cone-shaped section.

3. The method according to claim 1, wherein the solid material is wire, the processing of the solid material comprising cutting the wire to length using a massive-forming machine and/or center-punching the wire at one end face with a graining tool.

4. The method according to claim 1, wherein the processing of the solid material comprises forming a central depression in the end of the truncated-cone-shaped section, the splitting starting from the central depression.

5. The method according to claim 1, wherein the depth corresponds to a transition from the cylindrical section to the truncated-cone-shaped section.

6. A method for producing an expanding bullet, comprising:

providing a solid material; and processing, using massive forming, the solid material to produce the expanding bullet, wherein:

the expanding bullet has a cylindrical section and a truncated-cone-shaped section divided into segments, a bullet tip being situated at an end of the truncated-cone-shaped section that faces away from the cylindrical section;

the truncated-cone-shaped section includes at least one planned breaking point formed therein, and a channel having a mouth in a region of the bullet tip;

the processing of the solid material comprises splitting the end of the truncated-cone-shaped section into a plurality of segments and forming a central recess in the split end of the end of the truncated-cone-shaped section; and the processing of the solid material further comprises closing a bullet mold after forming the central recess, the segments being bent over in a direction of a central axis of the expanding bullet to form the channel.

7. The method according to claim 6, wherein the central recess is formed using a pin, the bullet mold being closed after extracting the pin from the solid material.

8. The method according to claim 6, wherein the processing of the solid material further comprises forming at least one flaw on a mantle surface of the truncated-cone-shaped section when the bullet mold is closed.

9. The method according to claim 6, wherein the processing of the solid material comprises:

splitting the end of the truncated-cone-shaped section into the segments;

penetrating, starting from the split end, into the truncated-cone-shaped section to a depth to form a central recess in the split end of the end of the truncated-cone-shaped section; and closing a bullet mold after forming the central recess to press the segments in a direction of a central axis of the expanding bullet to form the channel.

10. The method according to claim 9, wherein the depth corresponds to a transition from the cylindrical section to the truncated-cone-shaped section.

11. The method according to claim 9, wherein the channel has a bell-shaped widened region, a greatest diameter of the bell-shaped widened region being in a region of transition from the cylindrical section to the truncated-cone-shaped section.

* * * * *